United States Patent [19]

Goschke et al.

[11] Patent Number: 4,791,819

[45] Date of Patent: Dec. 20, 1988

[54] METHOD AND APPARATUS FOR MAKING COMPARATIVE ACOUSTIC MEASUREMENTS

[75] Inventors: Bernd Goschke, Hessdorf-Hannbert; Peter Nassler, Eckental, both of Fed. Rep. of Germany

[73] Assignee: Siemens Aktiengesellschaft, Berlin and Munich, Fed. Rep. of Germany

[21] Appl. No.: 36,390

[22] Filed: Apr. 9, 1987

[30] Foreign Application Priority Data

Apr. 25, 1986 [DE] Fed. Rep. of Germany ..... 3614131

[51] Int. Cl.[4] ..... H04R 29/00

[52] U.S. Cl. ..... 73/865.8

[58] Field of Search ..... 73/865.8, 865.9, 585; 381/60, 68.6, 69; 181/130, 134, 135, 137

[56] References Cited

U.S. PATENT DOCUMENTS

| | | | |
|---|---|---|---|
| 2,112,569 | 3/1938 | Lybarger | 179/107 |
| 3,157,245 | 11/1964 | Bernstein | 181/23 |
| 3,170,046 | 2/1965 | Leale | 179/107 |
| 3,408,461 | 10/1968 | Langford | 179/107 |
| 4,311,206 | 1/1982 | Johnson | 381/68.6 |
| 4,375,016 | 2/1983 | Harada | 181/135 |
| 4,392,547 | 7/1983 | Baker | 181/135 |
| 4,617,429 | 10/1986 | Bellafiore | 381/68.6 |

FOREIGN PATENT DOCUMENTS

| | | |
|---|---|---|
| 0010168 | 9/1979 | European Pat. Off. . |
| 0140078 | 5/1985 | European Pat. Off. . |
| 648172A5 | 2/1985 | Switzerland . |
| 2120594A | 5/1982 | United Kingdom . |

*Primary Examiner*—Stewart J. Levy
*Assistant Examiner*—Robert R. Raevis
*Attorney, Agent, or Firm*—Hill, Van Santen, Steadman & Simpson

[57] ABSTRACT

A single opto-plastic 7 is provided which can be inserted into the auditory passage of an ear which is to be serviced and has an outside contour which matches the auditory passage and includes a hollow interior 6 which communicates with the outside through a sound passage 9. The hollow interior 6 is shaped so that it can receive an in the ear hearing aid 3 or a coupling (4, 5) for a behind the ear hearing aid, thus allowing either of the units to be quickly connected to the opto-plastic ear piece 7 so that comparative measurements can be made by the patient.

1 Claim, 2 Drawing Sheets

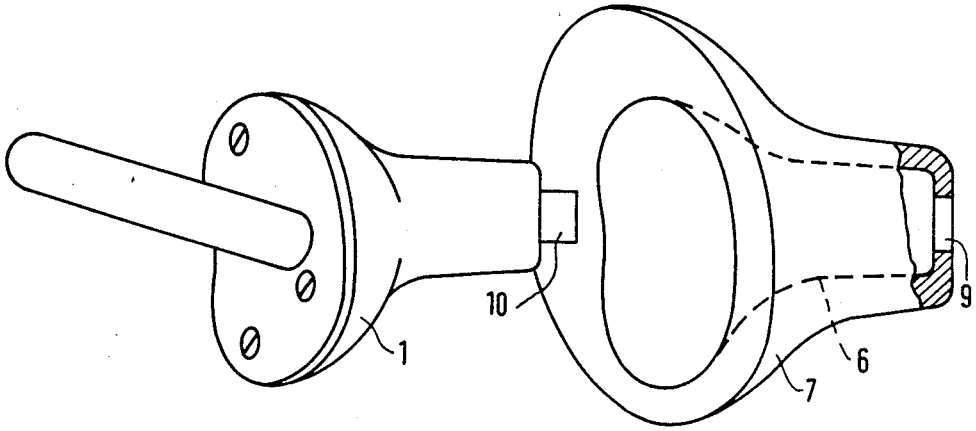
FIG 1
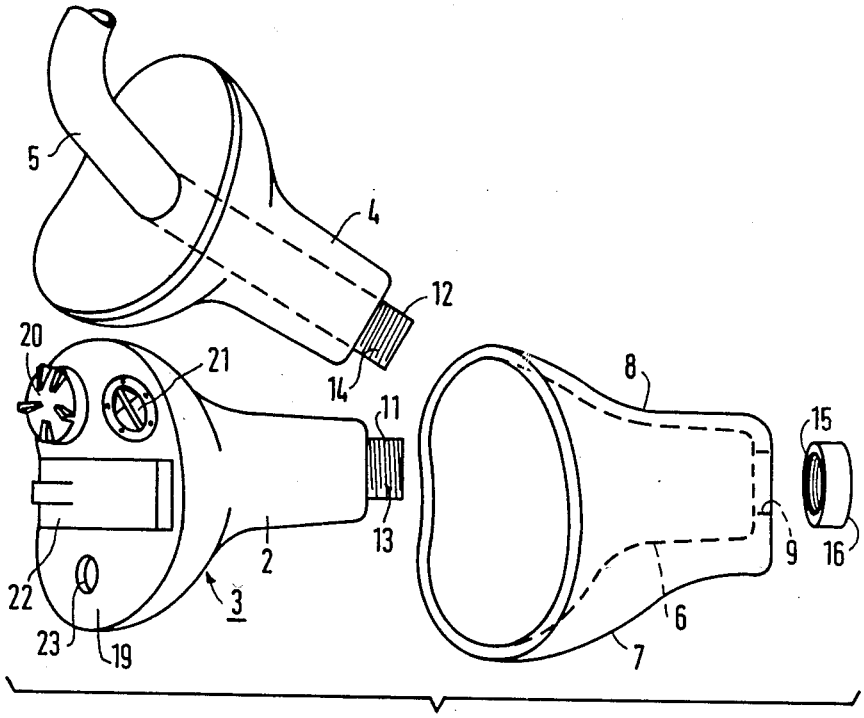
FIG 3
FIG 2

METHOD AND APPARATUS FOR MAKING COMPARATIVE ACOUSTIC MEASUREMENTS

BACKGROUND OF THE INVENTION

1. Field of The Invention

This invention relates to a method and apparatus for making comparative acoustic measurements with a patient and includes an opto-plastic earpiece which mounts in the ear and has an opening which can receive either an in-the-ear or a behind-the-ear hearing aid.

2. Description of the Prior Art

An opto-plastic earpiece having a hollow interior into which an in-the-ear hearing aid is at least partially insertable is disclosed, for example, in Swiss Pat. No. 648,172.

European patent application No. 01 40 078 discloses a behind-the-ear hearing aid which is connected to an ear button by means of a sound-conducting-tube and the ear button is insertable into the auditory passage of the ear.

The question as to which apparatus, in other words, the behind-the-ear hearing aid or in-the-ear hearing aid is the best solution for a hearing-impaired person in acoustical terms is usually clarified by making comparative acoustic measurements. For this purpose, both apparatus types are utilized by the hearing-impaired person in succession and he makes the decision as to which apparatus provides him with better hearing.

There is a disadvantage in that every apparatus type requires its own individual opto-plastic earpiece such as a housing shell for in-the-ear hearing aids and ear buttons for behind-the-ear hearing aids for mounting in the auditory passage. The manufacture of two separate opto-plastic earpieces is time-consuming and expensive. When a number of units of each apparatus type are acoustically compared to one another, it takes a substantial time in the prior art devices and this substantially increases the cost of servicing the patient. When using different individual opto-plastic earpieces, it is also not always possible to be assured that completely identical coupling conditions exist. So as to assure at least somewhat identical coupling conditions, particular care must be used when introducing the respective opto-plastic earpiece into the auditory passage so as to provide precise sealing from the outside and so forth. The insertion procedure requires a substantial amount of time. Since the acoustic memory of the hearing-impaired person is generally relatively short, misinterpretations of the acoustic comparison can occur due to this substantial time between the two tests.

SUMMARY OF THE INVENTION

It is an object of the present invention to provide a substantially more reliable acoustic comparison method and apparatus between in-the-ear and behind-the ear hearing aids than has been previously available and which uses optimally low cost technological outlay.

The object of the invention is achieved by a method and apparatus wherein a single opto-plastic earpiece 7 having an outside contour adapted to the shape of the auditory passage of the ear to be serviced has a hollow interior which communicates with a sound passage and an in-the-ear hearing aid is first inserted into the hollow interior of the earpiece and a hearing test is made with such device after which the in-the-ear hearing aid is removed from the hollow interior of the opto-plastic earpiece and a coupling means for a behind-the-ear hearing aid is inserted into the opening in the opto-plastic earpiece and a second auditory test is conducted.

The invention makes it possible for a single optoplastic earpiece to be prepared for the acoustical comparison and this always results in identical acoustical conditions in the inserted condition regardless of what particular type of hearing aid is being utilized. The overall cost outlay and the manufacturing of the opto-plastic earpiece in low and provides a cost saving. Since the acoustical coupling is the same for all tests, the devices can be interchanged much more quickly than with prior art procedures. The possibility of misinterpreting the acoustical comparison has been substantially eliminated. When a hearing impaired person has decided in favor of a apparatus type, then the opto-plastic earpiece utilized in the acoustical comparison can continue to be employed for the final servicing.

Other objects, features and advantages of the invention will be readily apparent from the following description of certain preferred embodiments thereof taken in conjunction with the accompanying although variations and modifications may be effected without departing from the spirit and scope of the novel concepts of the disclosure and in which:

BRIEF DESCRIPTION OF THE DRAWINGS

FIG. 1 is an exploded partially sectional view of an opto-plastic earpiece and a module die;

FIG. 2 is an exploded view of the opto-plastic earpiece of the invention and in-the-ear module device and an adapter piece for coupling a behind-the-ear device which can be optionally inserted into the opto-plastic earpiece;

FIG. 3 is a screw-on cover in plane view;

DESCRIPTION OF THE PREFERRED EMBODIMENTS

Figure 4:
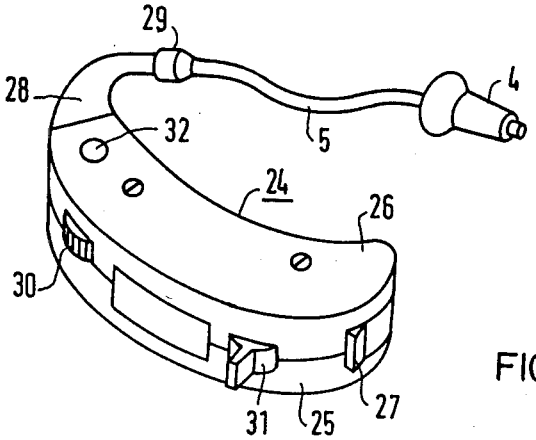
FIG. 4 is a perspective view of a behind-the-ear hearing aid with coupled adapter members.

FIG. 1 illustrates the method of making the opto-plastic earpiece 7 of the invention. A standard opening 6 is formed in the opto-plastic earpiece 7 using a module die 1 which has an outside contour corresponding to the outer housing 2 of an in-the-ear (ItE) module device 3 as well as the shape of an adapter member 4 which has a sound conducting tube 5 for connecting it to a behind-the-ear (Bte) device as illustrated in FIGS. 2 and 4. The hollow interior 6 is formed with the die 1 which forms the standard interior opening 6 as well as has a projecting portion 10 which forms the sound passage 9 in the opto-plastic earpiece 7.

It is to be realized that the external shape 8 of the opto-plastic earpiece 7 has a contour which corresponds to the auditory passage of the particular patient with whom the device is to be used.

As shown in greater detail in FIG. 2 either the ItE member 3 or the adapter member 4 of the BtE unit can be mounted in the opto-plastic earpiece shell 7. For example, the Ite unit 3 has an extending portion which fits into the opening 6 and has an end portion 11 which is formed with threads 13 such that when the unit 3 is inserted into the opto-plastic earpiece or shell 7 the threaded portion 11 extends externally out of the passage 9 so that a cap or cover member 16 which has internally formed threads 15 that mate with the threads 13 can be screwed onto the portion 11 to lock the unit 3 to the opto-plastic shell 7. The cover 16 has an end 17 formed with a plurality of openings 18 as illustrated in FIG. 3 which provide passageway openings into the hearing devices and serves as a serumen trap.

So as to make acoustic comparison wit a patient, for example, the ItE module device 3 is first inserted into the hollow interior 6 of the opto-plastic shell 7 until the end connector 11 projects through the sound passage 9. Then the screw-on cover is screwed onto the outside threads 13 of the end connector 11. The ItE module device 3 is now firmly seated in the hollow interior of the opto-plastic shell 7. The unit can then be introduced into the auditory passage of the ear of the hearing-impaired person who is to be serviced and it is inserted together with the opto-plastic shell 7 so as to execute a first acoustic measurement. After the first acoustic measurement has been accomplished, the combination of the ItE module device 3 and the opto-plastic shell 7 is removed from the auditory passage. Then the screw-off cover 16 is removed and the ItE module device 3 is removed from the hollow interior 6 of the opto-plastic shell 7. Next, an adapter member 4 is inserted into the hollow interior 6 and it has an extending end piece 12 which is externally threaded with threads 14 and the cover cap 16 is again screwed onto the extending portion 12 to lock the adapter member 4 in the opto-plastic shell 7. The sound tube 5 extends as illustrated in FIG. 4 to the BtE device and connects it to the adapter member so that a second acoustic measurement can be accomplished.

The invention allows very simple and quick manipulations which allow a switch to be made from a measurement with one apparatus to a measurement with the other apparatus. An acoustic comparison is thus possible by the patient in the shortest possible time.

As illustrated in FIG. 2, the ItE module device 3 has a volume control setting button 20 on its end surface 19 and also has an additional adjustment element 21 and a cover 22 for the battery compartment and an opening 23 for the sound supply.

The BtE device 24 is illustrated in FIG. 4 and comprises two half shells 25 and 26 which are connected together by suitable screws. A battery compartment 27 is mounted in the lower end and a carrying hook 28 is formed at the other end. The device 24 is worn behind the ear and is supported by carrying hook 28. The sound conducting hose 5 with the adapter member 4 is plugged on to the end 29 of the carrying hook as shown. A small adjustment volume control wheel 30 is provided as well as an operating switch 31 which may be an on and off switch and these are formed on the outwardly convex backside of the BtE device 24. The sound entry opening is the opening 32.

Figure 5:
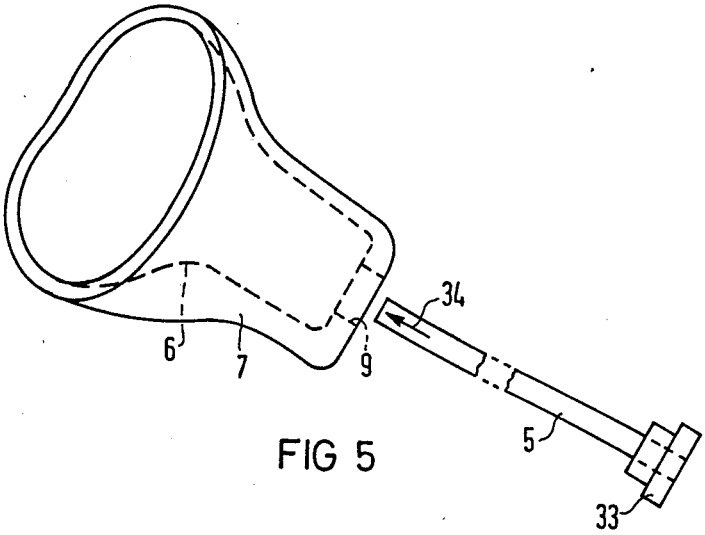
FIG. 5 is an exploded view of a modification of the invention.
Figure 6:
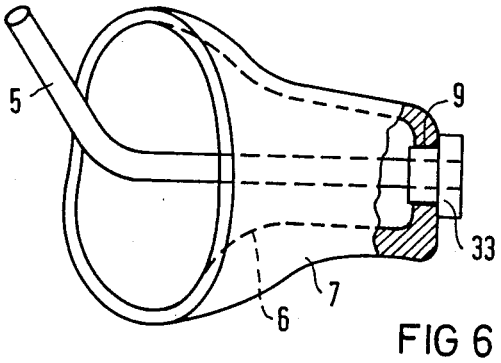
FIG. 6 is a partially sectional view of the modification.

FIGS. 5 and 6 illustrate an alternative device wherein a sound conducting tube 5 is directly coupled to the opto-plastic shell 7 without the use of an adapter member.

For this purpose, the sound conducting tube 5 has an elastic sealing plug 33 on one end and after the sound conducting tube 5 has been pushed through the sound passage 9 in the direction of the arrow 34, the sealing plug 33 is pressed into the sound conducting opening and firmly seated as shown in FIG. 6.

Subsequently, the end of the sound conducting tube 5 which extends away from the member 7 can be plugged into the end 9 of the carrying hook 28 of the BtE device 24 as illustrated in FIG. 4.

In the embodiment of FIG. 2, the adapter 4 is preferably made of solid plastic, for example, of an acetyl copolymerizate. It can also be formed of an elastic material. Due to the elasticity, the adapter can also be seated so tightly into the hollow interior of the opto-plastic shell 7 that a screw-on mechanism such as the screw-on cap 16 is not required. The opto-plastic shell 7 is preferably fabricated of acrylic.

Although the invention has been described with respect to preferred embodiments, it is not to be so limited as changes and modifications can be made which are within the full intended scope of the invention as defined by the appended claims.

We claim as our invention:

1. The method for identifying and testing a hearing aid suitable for an auditory canal of the ear of a hearing-impaired person on the basis of an acoustic comparison between an in-the-ear hearing aid and a behind-the-ear hearing aid by using an ear adapter, comprising the following steps:

(a) constructing a single optoplastic ear adapter (7) which has an outside contour which has the shape of said auditory canal of said ear, said adapter having a hollow interior (6) that encloses a sound-diverting opening (9), (b) alternately inserting said in-the-ear hearing aid (3) as a first insert part and a coupling means for said behind-the-ear hearing air (24) as a second insert part into the hollow interior of said optoplastic ear adapter (7) such that said in-the-ear hearing aid of said behind-the-ear hearing aid is in acoustic communication with said sound-diverting opening, (c) inserting said optoplastic ear adapter together with said in-the-ear hearing aid or together with said coupling means for said behind-the-ear hearing aid into said auditory canal of said ear, (d) making an acoustic measurement with one hearing aid;

(e) removing the first or second insert part from the optoplastic ear adapter (7) and inserting the second or first insert part of the other hearing aid, into said optoplastic ear adapter (7), (f) making an acoustic measurement with the other hearing aid, (g) and comparing the acoustic measurements made with the in-the-ear hearing aid and the behind-the-end hearing aid.

* * * * *